United States Patent [19]

Cohen

[11] 4,041,551

[45] Aug. 16, 1977

[54] WAISTBAND

[76] Inventor: Morris Cohen, 9250 Meilleur, Montreal, Quebec, Canada

[21] Appl. No.: 713,988

[22] Filed: Aug. 12, 1976

[51] Int. Cl.[2] ..... A41F 9/00

[52] U.S. Cl. ..... 2/236; 2/220

[58] Field of Search ..... 2/76, 220, 221, 236, 2/237

[56] References Cited

U.S. PATENT DOCUMENTS

| | | | |
|---|---|---|---|
| 2,630,575 | 3/1953 | Feinberg | 2/236 |
| 3,064,269 | 11/1962 | Scheitlin | 2/221 |
| 3,155,986 | 11/1964 | Miller | 2/236 |
| 3,221,346 | 12/1965 | Johnson et al. | 2/236 |

FOREIGN PATENT DOCUMENTS

| | | | |
|---|---|---|---|
| 757,093 | 9/1956 | United Kingdom | 2/236 |

*Primary Examiner*—H. Hampton Hunter

[57] ABSTRACT

A waistband comprising an outer band, a stiffening insert on the inner surface of the outer band, the outer band having an upper and a lower edge portions folded over the edges of the stiffening insert, an anti-slip band on the stiffening insert, a first lining with a first stiffening insert sewed to the lower folded over edge portion of the outer band by means of a first stitch, a second lining with a second stiffening insert positioned partly on the first lining and partly on the anti-slip band, the second lining being sewed by the first stitch to the outer band and by a second stitch passing through the anti-slip band to the outer band, a third lining with a third stiffening insert positioned partly on the upper folded over edge portion of the outer band and partly on the anti-slip band, the third lining being sewed by a third stitch passing through the anti-slip band to the outer band and by a fourth stitch to the upper folded over edge portion of the outer band. The first, second, third and fourth stitches extend through the body of the outer band and are visible on the outer surface of the waistband.

14 Claims, 3 Drawing Figures

WAISTBAND

The present invention relates to a waistband, more particularly to a waistband for a trouser.

Waistbands are shown in the following U.S. Pat. Nos.: 147,619; 1,712,305; 1,979,300; 2,133,225; 2,630,575; 2,912,699; 3,129,434; 3,155,986; 3,562,817; 3,745,588; 3,761,966. Each of these patents discloses one or more particular arrangements of a waistband element.

However, the drawbacks of the known waistbands reside in the fact that they are time consuming to manufacture, they lack extra firmness which gives extra comfort and non roll features to the waistband.

In order to overcome the above drawbacks the present waistand has been invented. This inventive waistband has the characteristics of being more economicaly manufactured than the conventinal waistbands, resisting better to wear, having extra firmness which gives extra comfort and non roll features to the waistband, and has features adding fashion to the entire trouser thus enhancing the selling value thereof.

Accordingly, the present invention provides a waistband comprising an outer band, a stiffening insert on the inner surface of the outer band, said outer band having an upper and a lower edge portions folded over the edges of said stiffening insert, an anti-slip band on the stiffening insert, a first lining with a first stiffening insert sewed to the lower folded over edge portion of the outer band by means of a first stitch, a secnd lining with a second stiffening insert positioned partly on the first lining and partly on the anti-slip band, the second lining being sewed by the first stitch to the outer band and by a second stitch passing through said anti-slip band to the other band, and a third lining with a third stiffening insert positioned partly on the upper folded over edge portion of the outer band and partly on the anti-slip band, the third lining being sewed by a third stitch passing through the anti-slip band to the outer band and by a fourth stitch to the upper folded over edge portion of said outer band. The first, second, third and fourth stitches extend through the body of the outer band and are visible on the outer surface of the waistband.

According to one aspect of the present invention, the waistband, comprises an outer band; a stiffening insert provided adjacent the inner surface of the outer band, the outer band having an upper and a lower edge portions folded over the edges of the stiffening insert; and anti-slip band having a surface adjacent the surface of the stiffening insert which is opposite the inner surface of the outer band, the anti-slip band having another surface provided with an anti-slip band having another surface provided with an anti-slip element, a first lining folded into two folds along a fold line and sandwiching a first stiffening insert between the folds, the first lining along with its stiffening insert being sewed at their free edges opposite said fold line to the lower folded over edged portion of the outer band by means of a first stitch; a second lining and a second stiffening insert for the second lining, the second lining having its edge portions folded over the edges of the second insert, the second lining with its insert being positioned partly on the first lining and partly on the anti-slip band, and having one of its folded over edge portions which is positioned on the first lining sewed to the outer band by means of the first stitch and having the other of its folded over edge portions which is positioned on the anti-slip band sewed to the outer band by means of a second stitch; and a third lining and a third stiffening insert for the third lining, the third lining having its edge portions folded over the edges of the third insert, the third lining with its insert being positioned partly on the upper folded over edge portion of the outer band and partly on the anti-slip band, and having one of its folded over edge portions which is positioned on the anti-slip band sewed to the outer band by means of a third switch and having the other of its folded over edge portions which is positioned on the upper folded over edge portion of the outer band sewed to the outer band by means of a fourth stitch. The second and third stitches also secure the anti-slip band to the outer band, the anti-slip element being positioned between the second and third stitches. The first, second, third and fourth stitches extend through the body of the outer band and are visible on the outer surface of the waistband.

When the waistband according to the present invention is used for a trouser, there is further provided one edge portion of the trouser material which is placed between the first lining and the outer band, this edge portion of the trouser material being sewed to the outer band by means of the first stitch.

Preferably, the second lining and the third lining are symmetrically disposed on each side of the anti-slip band, and the anti-slip band which may be made of rubber is disposed centrally to the waistband.

Preferably, the first lining has its folds extending beyond the lower folded over edge portion of the waistband, and overlapping the trouser material, the folds hanging downwardly adjacent the trouser material from the lower folded over edge portion of the waistband.

Preferably, the first, second, third and fourth stitches are equidistant, and the distances between the four rows of stitches are equal.

A preferred embodiment of the invention will now be described in a non-limited manner with reference to the attached drawing wherein.

Figure 3:
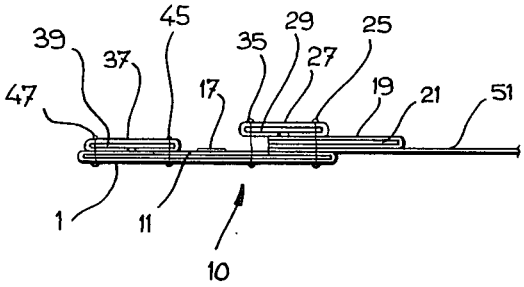
FIG. 3 shows a side view of the waistband according to the present invention.
Figure 1:
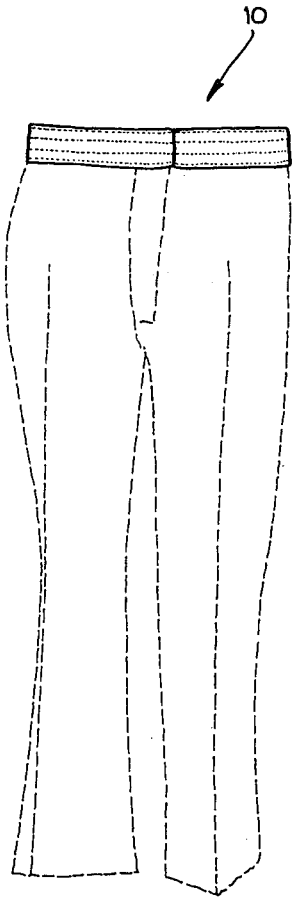
FIG. 1 shows a perspective view of a trouser provided with a waistband according to the present invention.
Figure 2:
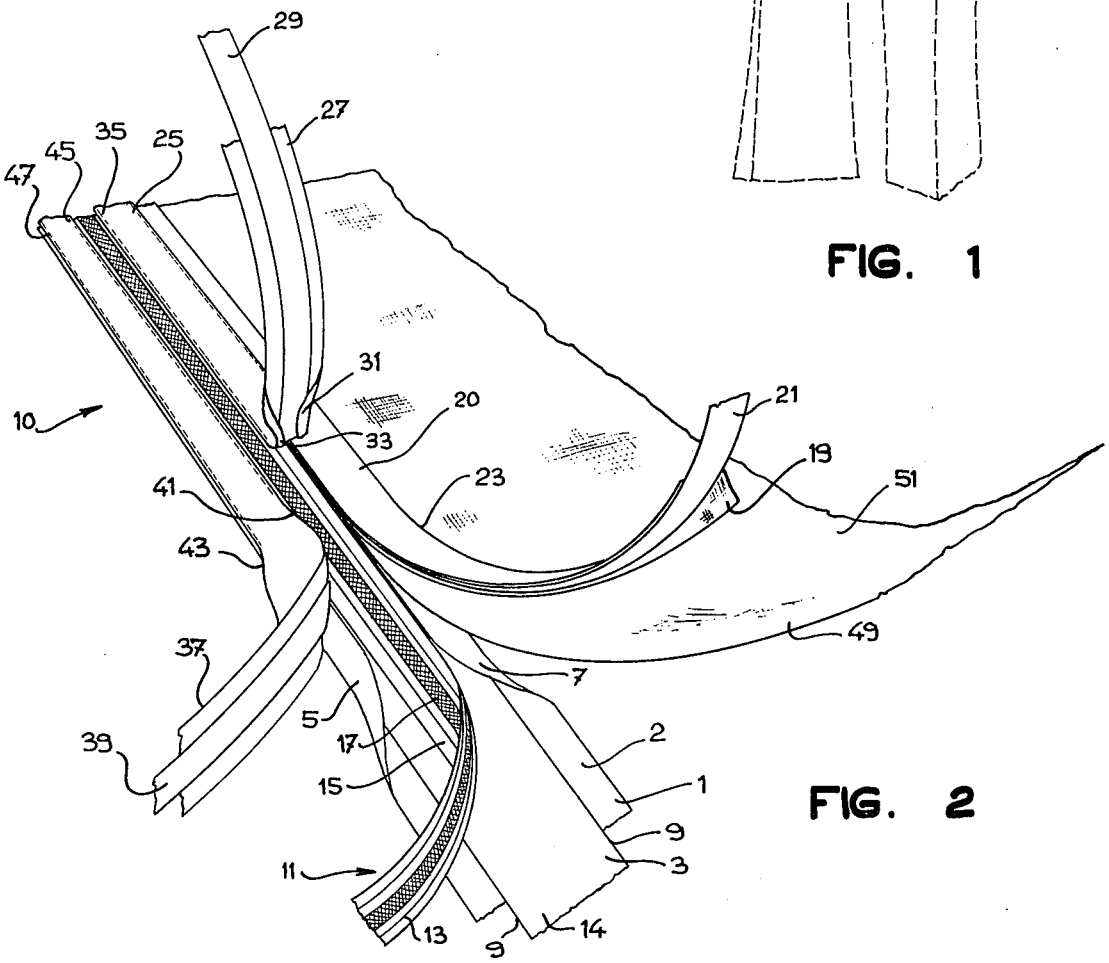
FIG. 2 shows in perspective view a portion of a waistband according to the present invention.

Now referring to the drawings, and more particularly to FIG. 2, it is shown therein a portion of a waistband 10 comprising an outer band 1 and a stiffening insert 3 placed on the inner non-visible surface of the outer band 1. The upper edge portion 5 and the lower edge portion 7 of the outer band 1 are folded over the edges 9 of the stiffening insert 3. By upper edge portion 5 is to be understood the edge portion which is on the side of the shoulder of the wearer of the trouser and by lower edge portion 7 it should be understood the edge portion on the side of the legs of the wearer of the trouser.

An anti-slip band 11 is placed on the stiffening insert 3, the anti-slip band 11 having a surface 13 adjacent the surface 14 of the stiffening insert 3 which is opposite to the non-visible surface of the outer band 1. The other surface 15 of the anti-slip band 11 is provided with an anti-slip element 17 in order to prevent, by frictional grip, the rising of the shirt from the inside of the trouser.

The anti-slip band 11 is disposed centrally to the waistband 10.

A first lining 19 which is folded into two folds 20 along a fold line 23 is sewed on the lower folded over edge portion 7 of the outer band 1. A first stiffening insert 21 is sandwiched between the flaps or folds 20 of the first lining 19. The first lining 19 along with its stiffening insert 21 are sewed as above mentioned at their free edges opposite the fold line 23 of the first lining 19 to the lower folded over edge portion 7 of the outer band 1 by means of a first stitch 25.

There are provided a second lining 27 and a second stiffening insert 29 for the second lining 27. The second lining 27 has its lateral edge portions 31 and 33 folded over the edges of the second insert 29. The second lining 27 with its stiffening insert 29 is positioned partly on the first lining 19 and partly on the anti-slip band 11 in such a way that one 31 of its folded over edge portions which is positioned on the first lining 19 is sewed through the first lining 19 and its insert 21 to the outer band 1 by means of the first stitch 25 and the other 33 of the folded over edge portions which is positioned on the anti-slip band 11 is sewed through the anti-slip band 11 to the outer band 1 by means of a second stitch 35.

There are also provided a third lining 37 and a third stiffening insert 39 for the third lining. The third lining has its lateral edge portions 41 and 43 folded over the edges of the third insert 30. The third lining 37 with its stiffening insert 39 is positioned partly on the upper folded over edge portion 5 of the outer band 1 and partly on the anti-slip band 11 in such a way that one 41 of its folded over edge portions which is positioned on the anti-slip band 11 is sewed through the anti-slip band 11 to the outer band 1 by means of a third stitch 45 and the other 43 of its folded over edge portions which is positioned on the upper folded over edge portion 5 of the outer band 1 is sewed through the upper folded over edge portion 5 to the outer band 1 by means of a fourth stitch 47.

The second 35 and the third 45 stitches also secure the anti-slip band 11 to the outer band 1. In this manner the anti-slip element 17 is caught between the second 35 and the third 45 stitches.

The four rows of stitches, first 25, second 35, third 45 and fourth 47 extend through the body of the outer band 1 and are visible on the outer surface of the waistabnd 10. Such a stitching not only gives added fashion but a new type of firmness not found in conventional waistbands.

When the waistband is intended to be sewed on a trouser, one edge portion 49 of the trouser material 51 is placed between the first lining 19 and the lower folded over edge portion 7 of the outer band 1 and is sewed to the outer band by means of the first stitch 25. The first lining 19 thus secured to the outer band 1 and to the trouser material 51 has its folds 20 extending beyond the lower folded over edge portion 7 of the waistband 10 and overlapping the trouser material 51. The fold line 23 of the first lining 19 is not sewed to the trouser material 51 and the folds 20 hang downwardly adjacent to the trouser material 51 from the lower folded over edge portion 7 of the waistband 10.

The second lining 27 and the third lining 37 are symmetrically disposed on each side of the anti-slip band 11. The latter is disposed centrally to the waistband 10.

The four rows of stitches are equidistant to each other and the distances between each two rows of stitches are equal.

A waistband as above described is a one piece sealed unit which allows for easy care when washing or dry cleaning.

The different linings and different inserts are made of a non-woven material for extra firmness.

The anti-slip element may be made of rubber, neoprene, foam, polyester or any other anti-slip material.

The above mentioned waistband 10 is manufactured by means of an attachment which automatically feeds the various linings and their inserts into an industrical sewing machine. With such an attachment when the linings and particularly the second 27 and the third 37 linings are fed into the sewing machine they have their edges automatically folded over in order that when they arrive under the sewing machine they are stitched in this position to the other elements of the waistband.

The attachment comprises channel like elements with upturned edges provided for folding over the linings. The attachment also comprises channel like means for simultaneously feeding into the sewing machine the remaining elements of the waistband.

It should be noted that the conventional methods presently used to apply a waistband to a pair of trousers comprise:

a. attaching a waistband lining to cloth part of the waistband;

b. attaching the part constructed in (a) to the trouser material;

c. pressing open of seams;

d. stitching down a waistband lining to the trouser material.

Variations in the material and other equivalent variations of the present waistband should be considered as falling into the scope of the present invention.

I claim:

1. A waistband, comprising an outer band, a stiffening insert on the inner surface of said outer band, said outer band having an upper and a lower edge portions folded over the edges of said stiffening insert, an anti-slip band on said stiffening insert, a first lining with a first stiffening insert sewed to said lower folded over edge portion of said outer band by means of a first row of stitches, a second lining with a second stiffening insert positioned partly on said first lining and partly on said anti-slip band, said second lining being sewed by said first row of stitches to said outer band and by a second row of stitches stitch passing through said anti-slip band to said outer band, a third lining with a third stiffening insert positioned partly on said upper folded over edge portion of said outer band and partly on said anti-slip band, said third lining being sewed by a third row of stitches passing through said anti-slip band to said outer band and by a fourth row of stitches to said upper folded over edge portion of said outer band, said first, second, third and fourth row of stitches extending through the body of said outer band and being visible on the outer surface of the waistband.

2. A waistband according to claim 1, for use in a trouser further comprisng one edge portion of the trouser material placed between said first lining and said outer band, said edge portion of said trouser material being sewed to said outer band by means of said first row of stitches.

3. A waistband according to claim 1, wherein said second lining and said third lining are symmetrically disposed on each side of said anti-slip band.

4. A waistband according to claim 3, wherein said anti-slip band is disposed centrally to said waistband.

5. A waistband according to claim 2, wherein said first lining has folds which extend beyond the lower folded over edge portion of said waistband and overlaps the trouser material.

6. A waistband according to claim 1, wherein said first, second, third and fourth row of stitches are equidistant.

7. A waistband, comprising an outer band, a stiffening insert provided adjacent the inner surface of said outer band, said outer band having an upper and a lower edge portions folded over the edges of said stiffening insert, an anti-slip band having a surface adjacent the surface of said stiffening insert which is opposite the inner surface of said outer band, said anti-slip band having another surface provided with an anti-slip element, a first lining folded into two folds along a fold line and sandwiching a first stiffening insert between said folds, said first lining along with its stiffening insert being sewed at their free edges opposite said fold line to the lower folded over edge portions of said outer band by means of a first row of stitches, a second lining and a second stiffening insert for said second lining, said second lining having its edge portions folded over the edges of said second insert, said second lining with its insert being positioned partly on said first lining and partly on said anti-slip band, and having one of its folded over edge portions which is positioned on said first lining sewed to said outer band by means of said first row of stitches and having the other of its folded over edge portions which is positioned on said anti-slip band sewed to said outer band by means of a second row of stitches, a third lining and a third stiffening insert for said third lining, said third lining having its edge portions folded over the edges of said third insert, said third lining with its insert being positioned partly on said upper folded over edge portion of said outer band and partly on said anti-slip band, and having one of its folded over edge portions which is positioned on said anti-slip band sewed to said outer band by means of a third row of stitches and having the other of its folded over edge portions which is positioned on said upper folded over edge portion of said outer band sewed to said outer band by means of a fourth row of stitches, said second and third rows of stitches also securing said anti-slip band to said outer band, said anti-slip element being positioned between said second and third rows of stitches, said first, second, third and forth rows of stitches extending through the body of said outer band and being visible on the outer surface of the waistband.

8. A waistband according to claim 7, wherein said first lining is placed on one edge portion of a trouser material, said trouser material being secured to said outer band by means of said first row of stitches.

9. A waistband according to claim 7, wherein said anti-slip element is made of rubber.

10. A waistband according to claim 7, wherein said second lining and said third lining are symmetrically disposed on each side of said anti-slip band.

11. A waistband according to claim 7, wherein said anti-slip band is disposed centrally to said waistband.

12. A waistband according to claim 7, wherein said first, second, third and fourth rows of stitches are equidistant.

13. A waistband according to claim 8, wherein said first lining has its folds extending beyond the lower folded over edge portion of the waistband, and overlapping the trouser material, the folds hanging downwardly adjacent said trouser material from said lower folded over edge portion of the waistband.

14. A waistband, comprising an outer band, a stiffening insert on the inner surface of said outer band, an anti-slip band on said stiffening insert, a first lining with a first stiffening insert sewed to a lower part of said outer band by means of a first row of stitches, a second lining with a second stiffening insert sewed by said first row of stitches to said outer band and by a second row of stitches passing through said anti-slip band to said outer band, a third lining with a third stiffening insert sewed by a third row of stitches passing through said anti-slip band to said outer band and by a fourth row of stitches to an upper part of said outer band, said first, second, third and fourth rows of stitches extending through the body of said outer band and being visible on the outer surface of the waistband.

* * * * *